US005960951A

United States Patent [19]

Nomura et al.

[11] Patent Number: 5,960,951

[45] Date of Patent: Oct. 5, 1999

[54] LENS CASE CONTAINING LENSES WITH REDUCED CONTACT AREA

[75] Inventors: Yoshimitsu Nomura; Masaaki Fukuda; Takashi Ito; Kaneyoshi Yagi, all of Saitama, Japan

[73] Assignee: Fuji Photo Optical Co., Ltd., Saitama, Japan

[21] Appl. No.: 09/097,007

[22] Filed: Jun. 15, 1998

[30] Foreign Application Priority Data

Jun. 24, 1997 [JP] Japan ..... 9-167678

[51] Int. Cl.[6] ..... B65D 85/38

[52] U.S. Cl. ..... 206/316.1; 206/499; 206/718

[58] Field of Search ..... 206/316.1, 718, 206/499, 328

[56] References Cited

U.S. PATENT DOCUMENTS 4,043,485 8/1977 Tippetts ..... 206/499 X
4,690,274 9/1987 Lue ..... 206/718
5,284,241 2/1994 Winton et al. ..... 206/499 X
5,435,446 7/1995 Hosseinmardi et al. ..... 206/718 X
5,509,574 4/1996 Lenz et al. ..... 206/718 X

FOREIGN PATENT DOCUMENTS 0219776 9/1990 Japan ..... 206/328

*Primary Examiner*—Bryon P. Gehman
*Attorney, Agent, or Firm*—Leydig, Voit & Mayer, Ltd.

[57] ABSTRACT

A lens case containing lenses includes a tubular case body and lenses contained in the case body. The case body includes first and second opposed walls having respective inner surfaces, and two protrusions projecting from each of the inner surfaces. The protrusions on the inner surface of the first wall are directly opposite corresponding protrusions on the inner surface of the second wall. Each of the lenses has a central optically functioning part and circumferential peripheral flanges, and the flanges of the lenses abut the protrusions.

20 Claims, 7 Drawing Sheets

LENS CASE CONTAINING LENSES WITH REDUCED CONTACT AREA

BACKGROUND OF THE INVENTION

1. Field of the Invention

The present invention relates to a lens case for transporting a light-weight, small-sized lens; and, in particular, to a lens case for transporting a plastic lens employed, for example, in a pickup optical system for reading out information recorded in a CD, DVD, or the like.

2. Related Background Art

Conventionally, a small-sized, lightweight lens is employed in a pickup optical system for reading out information recorded in a recording medium such as a CD, DVD, or the like. The lens is made of a plastic into a diameter of about several millimeters. FIG. 8 shows an example of such a lens. The lens 10 shown in FIG. 8 is made by injection molding of an acrylic resin or the like. The center of the lens 10 is formed with an optically functioning part 10*a* which functions as an optical lens. The outer peripheral part of the optically functioning part 10*a* is formed with a flange 10*b* having a flat part 10*c* which functions as a base surface when the lens is mounted to a pickup optical system (not depicted). Also, the flat part 10*c* projects beyond the surface (lens face) of the optically functioning part 10*a* along the optical axis direction of the lens 10, so that the flange 10*b* functions to protect the optically functioning part 10*a*.

Upon shipping or the like, such a lens is transported while being accommodated in a lens case such as that shown in FIG. 9. The lens case 101 shown in FIG. 9 comprises a case main body 102. The case main body 102 is formed like an elongated pipe and has an inner space 103 for accommodating the lens 10. The case main body 102 is manufactured by extruding a synthetic resin. The inner space 103 has a quadrangular cross section. When being transported, the lens 10 is accommodated within the inner space 103 of the case main body 102. The flat part 10*c* of the flange 10*b* comes into contact with inner faces 104*a* and 105*a* of upper and lower walls 104 and 105 which form the inner space 103. In the lens case 101, a number of lenses 10 are accommodated with some play along the longitudinal direction of the case main body 102.

The above-mentioned conventional lens case, however, has the following problems. Namely, it has been difficult to take out the lenses from the lens case. Also, dust and dirt are likely to stick to and hard to remove from the lenses taken out from the lens case.

SUMMARY OF THE INVENTION

In order to overcome the above-mentioned problems, it is an object of the present invention to provide a lens case from which lenses are easily taken out, and which is excellent in handling the lenses taken out therefrom.

The lens case according to the present invention is a lens case for accommodating therein a lens having a flange formed on an outer periphery of an optically functioning part. The lens case comprises a case main body, formed like an elongated pipe, having an inner space for accommodating the lens. Here, as a result of diligent studies conducted in order to overcome the shortcomings in the conventional lens case, the inventors have found that the cause for the above-mentioned shortcomings lies in the following.

For example, in the conventional lens 101, the inner faces 104*a* and 105*a* of the upper and lower walls 104 and 105 forming the inner space 103 are completely flat.

Accordingly, when the lens 10 is accommodated in the inner space 103, a large contact area would be formed between the inner faces 104*a* and 105*a* and the flat part 10*c* of the flange 10*b*. Upon transportation or the like, the lens 10 is moved within the case main body 102 in the longitudinal direction due to vibrations or the like. As a result, frictional electricity is generated by friction occurring in the contact area between the case main body 102 and the lens 10, i.e., between the inner faces 104*a* and 105*a* and the flat part 10*c* of the flange 10*b*. Accordingly, the case main body 102 and the lens 10 are charged, whereby the very small, lightweight lens 10 is attracted to the case main body 102. Therefore, it is difficult to take out the lens 10 from the case main body 102. Also, even after the lens 10 is taken out from the case main body 102, the lens is left charged, whereby dust and dirt are likely to stick to the lens 10, taking up time and labor for removing them.

In view of such results of studies, the lens case according to the present invention comprises a protrusion formed at each of the two walls forming the inner space and opposing each other. The protrusion projects from the inner face of each wall along the optical axis direction of a lens accommodated in the inner space. The protrusion abuts the flange of the lens.

When a lens is accommodated in the lens case according to the present invention, only the protrusions formed on the inner faces of the walls opposing each other abut the surface of the flange, so that the lens is held within the lens case. Accordingly, as compared with the case where the flat inner face of the wall and the surface of the flange come into contact with each other, the contact area between the lens and the case main body would become smaller. Therefore, the friction generated between the lens and the case main body due to vibrations upon transportation or the like decreases, thus reducing charges of the lens and case main body. As a result, the lens is prevented from being attracted to the case main body, whereby the lens can be easily taken out from the case main body. Also, since the charge of the lens taken out from the lens case decreases, dust and dirt are prevented from sticking to the lens.

Preferably, in this case, the protrusion extends from one end of the case main body to the other end thereof. As a consequence, the protrusion can be formed together with the case main body and inner space by extrusion.

Preferably, the protrusions are arranged in two rows and in parallel to each other. As a consequence, the lens can be held in a stable state within the inner space of the case main body. When being loaded into or taken out from the case main body, the lens moves within the inner space along the two parallel protrusions, whereby the lens can be easily inserted into the lens case, and the ease in taking out the lens therefrom can be improved.

Preferably, the protrusion has a semicircular cross section. Alternatively, the protrusion may have a triangular or quadrangular cross section. As a consequence, the contact area between the protrusion and the flange of the lens can be made very small.

Preferably, the case main body is made of a synthetic resin, and the inner space and the protrusion are formed together with the case main body by extrusion. Preferably, assuming that the protrusion has a width of b and a height of h, and that the inner space has a width of B and a height of H, $b \leqq B/5$ and $h \leqq H/5$ are satisfied. Preferably, depending on the form of the lens to be accommodated in the lens case, a recess is further provided in order to prevent the wall and the optically functioning part from interfering with each other.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
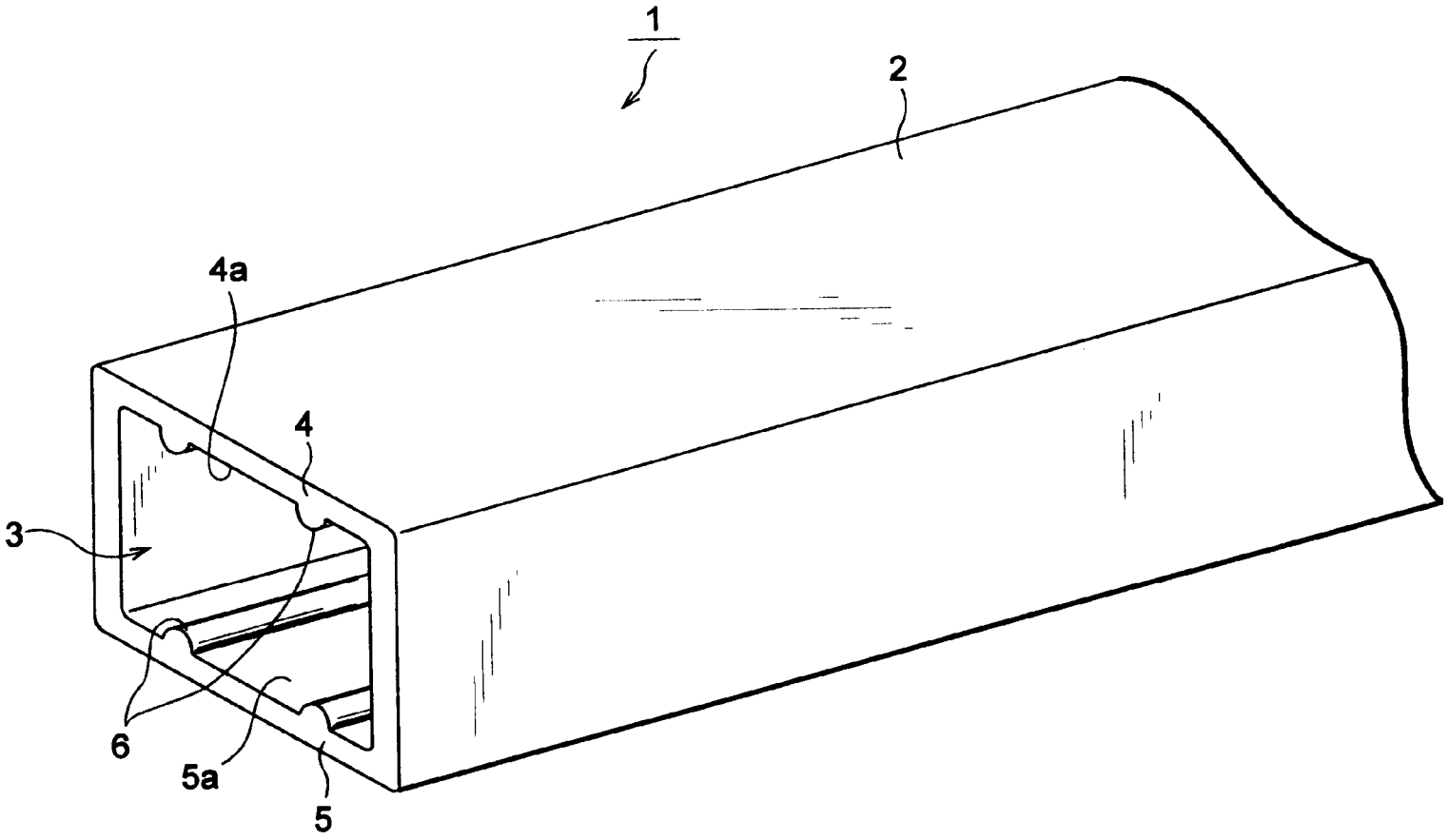
FIG. 1 is a perspective view showing a first embodiment of the lens case according to the present invention.
Figure 8:
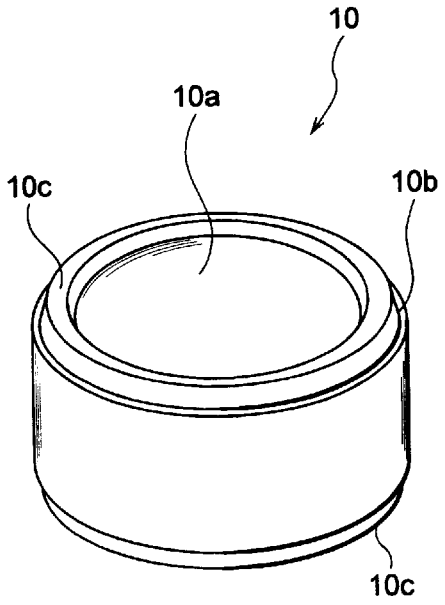
FIG. 8 is a perspective view showing a typical plastic lens.
Figure 9:
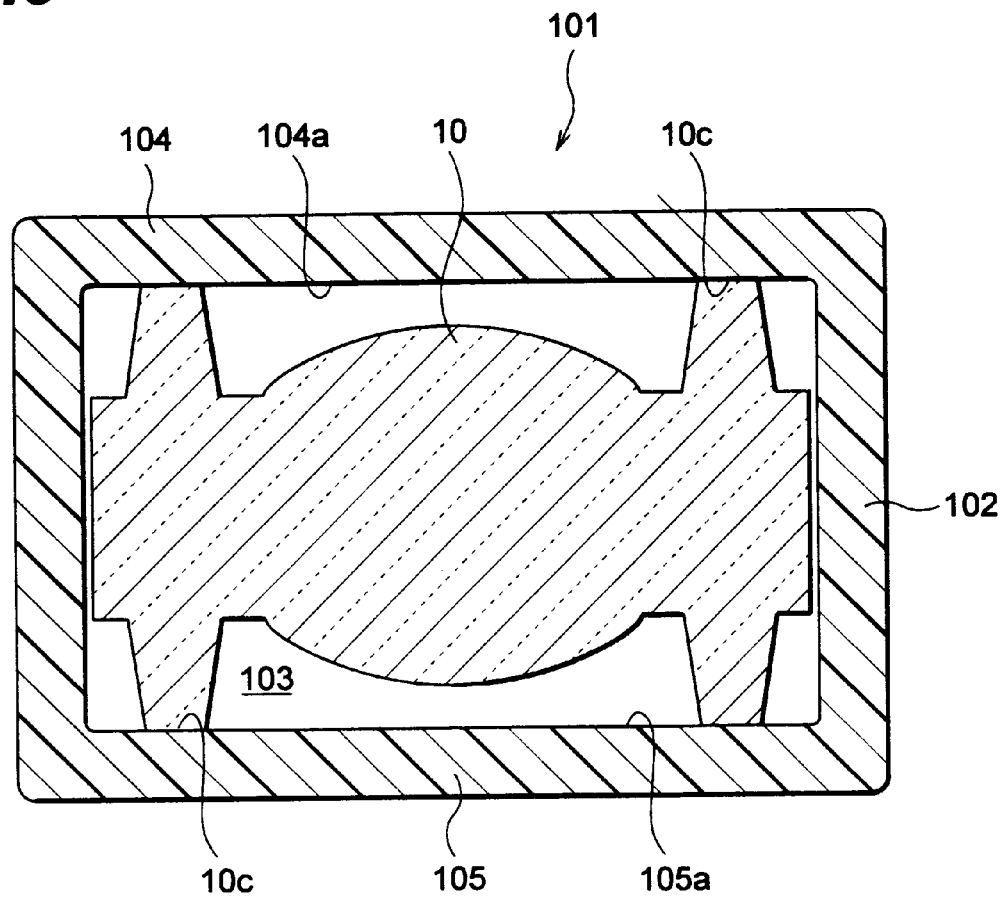
FIG. 9 is a sectional view showing a state of a conventional lens case accommodating a lens therein.

FIG. 1 is a perspective view showing a first embodiment of the lens case according to the present invention. The lens case 1 shown in FIG.1 is used for accommodating therein a typical plastic lens 10 (having a diameter of about 4.5 to 8 mm, see FIG. 8). The lens 10 is employed in a pickup optical system or the like for reading out information recorded in a CD, DVD, or the like. The lens case 1 comprises a case main body 2 formed like an elongated rectangular pipe.

The case main body 2 is made of a synthetic resin such as rigid vinyl chloride and has a characteristic of a dielectric. The case main body 2 has an inner space 3 for accommodating the lens, whereas both ends of the case main body 2 are open. The inner space 3 is formed together with the case main body 2 by extrusion. The whole length of the case main body 2 is about 700 mm, for example, whereby the inner space 3 can accommodate therein 50 to 100 pieces of lenses with some play. For example, upon shipping or the like, a number of lenses 10 are successively inserted into the inner space 3 from one end of the case main body 2, and then the lens case 1 is transported with both ends sealed.

Figure 2:
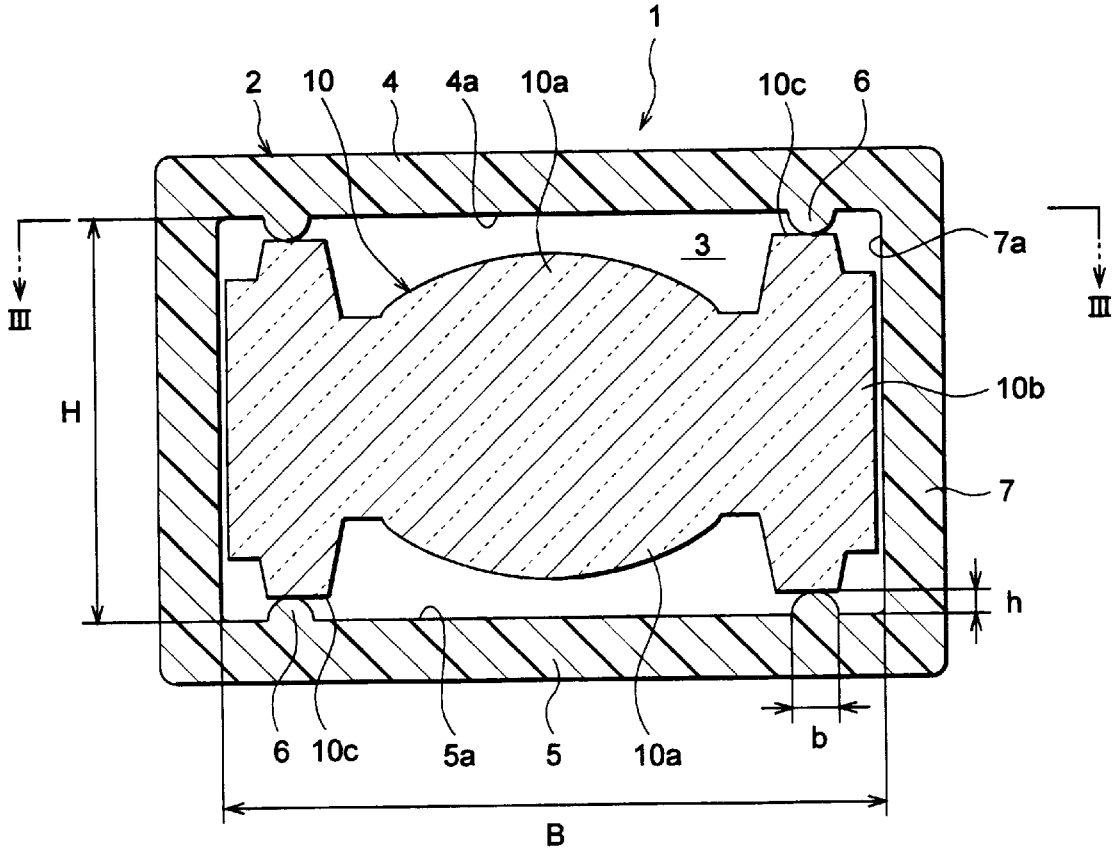
FIG. 2 is a sectional view showing a state of the lens case shown in FIG. 1 accommodating a lens therein.

As shown in FIG. 2, the cross-sectional form of the inner space 3 is quadrangular (substantially rectangular). The width and height of the inner space 3 are determined in accordance with the diameter and height of the lenses accommodated in the lens case 1. Of the four walls forming the inner space 3, the upper wall 4 is provided with protrusions 6 projecting downward from the inner face 4*a* of the upper wall 4. Similarly, the lower wall 5 opposing the upper wall 4 is provided with protrusions 6 projecting upward from the inner face 5*a* of the lower wall 5. The inner face 4*a* of the upper wall 4 is provided with two rows of protrusions 6 which are in parallel with each other, whereas the inner face 5*a* of the lower wall 5 is similarly provided with two rows of protrusions 6 which are in parallel with each other. Each protrusion 6 extends from one end of the case main body 2 to the other end thereof. Each protrusion 6 is formed together with the case main body 2 and the inner space 3 by extrusion. Thus, each protrusion 6 can be formed easily.

As shown in FIG. 2, when the lens 10 is accommodated in the lens case 1, the protrusions 6 project from the inner faces 4*a* and 5*a* of the upper and lower walls 4 and 5 along the optical axis direction of the lens 10. Each protrusion 6 abuts a flat part 10*c* of a flange 10*b* formed in the lens 10. As a consequence, the lens 10 is held within the inner space 3 of the case main body 2. Here, the lens 10 (flat part 10*c* of the flange 10*b*) contacts with only each projection 6 and would not directly come into contact with the inner faces 4*a* and 5*a* of the upper and lower walls 4 and 5.

Consequently, the contact area between the lens 10 and the case main body 2 would decrease as compared with the case where the flat inner faces 4*a*, 5*a* of the upper and lower walls 4, 5 and the surface of the flange 10*b* come into contact with each other. As a result, the friction generated between the lens 10 and the case main body 2 due to vibrations upon transportation and the like decreases, thereby reducing the charges of the lens 10 and case main body 2. Accordingly, the lens 10 is prevented from being attracted to the case main body 2, whereby the lens 10 can be easily taken out from the case main body 2. Also, since the charge of the lens 10 taken out from the lens case 2 is reduced, dust and dirt can be prevented from sticking to the lens 10. Hence, the case main body 2 can be made of not only synthetic resins but also various kinds of dielectric materials that can be easily molded.

In this case, assuming that the protrusion 6 has a width of b and a height of h, and that the inner space 3 has a width of B and a height of H, quite favorable results can be obtained in practice when the protrusion 6 is formed such as to satisfy relational expressions of $b \leqq B/5$ and $h \leqq H/5$. Preferably, the width of b and the height of h are more than 0.1 mm in order to prevent an irregularity in molding and to form the protrusion 6 favorably.

Also, the lens 10 accommodated in the case main body 2 contacts the protrusions 6 that are arranged in two rows and in parallel with each other at the upper and lower walls 4 and 5. As a result, the lens 10 can be held within the inner space 3 in a stable state. When being loaded into or taken out from the case main body 2, the lens 10 moves within the inner space 3 along two rows of parallel protrusions 6, whereby the lens 10 can be easily inserted into the lens case 1, and the ease in taking out the lens 10 therefrom would be improved.

Figure 3:
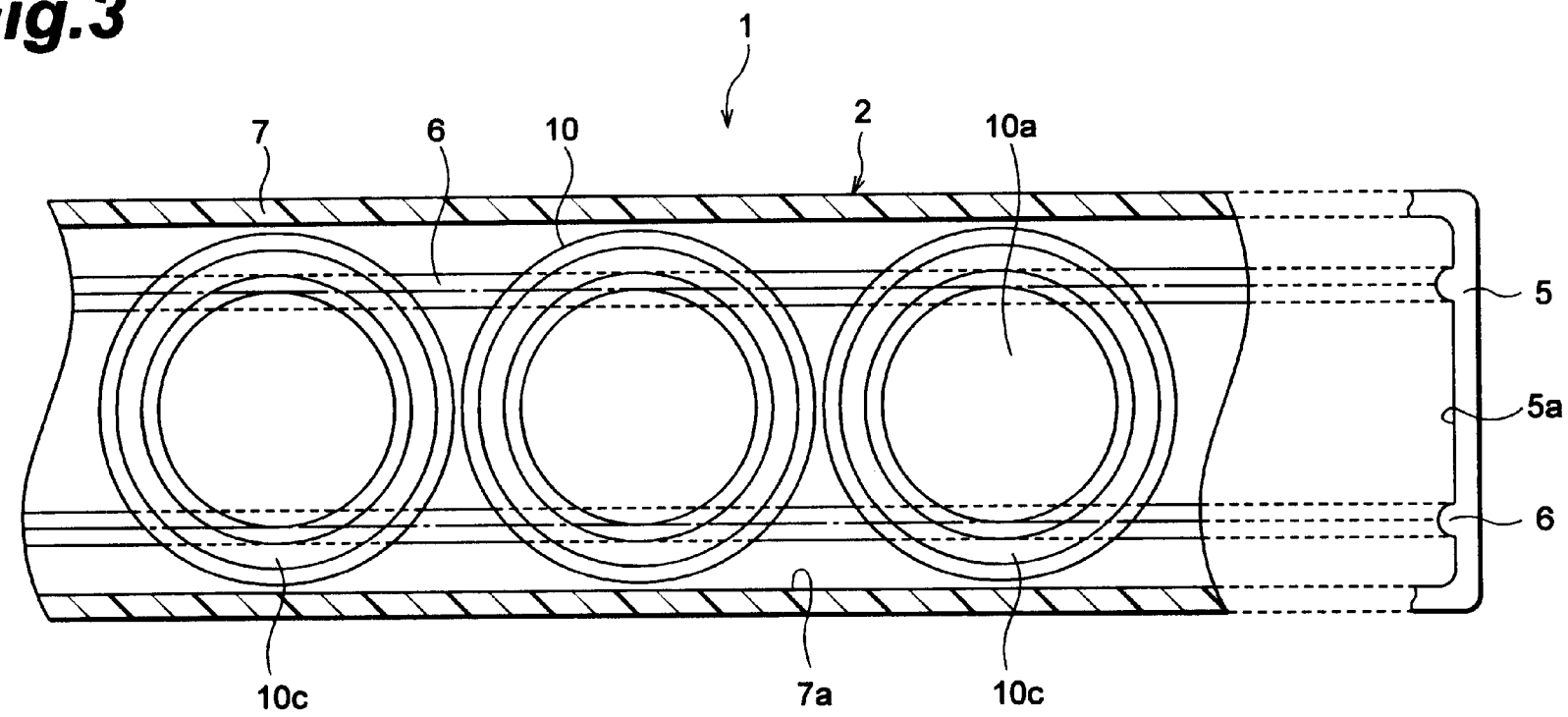
FIG. 3 is a sectional view taken along line III—III in FIG. 2.

Here, as shown in FIGS. 1 and 2, each protrusion 6 has a semicircular cross section. Accordingly, only the area near the top part of each protrusion 6 indicated by dashed lines in FIG. 3 comes into contact with the flat part 10*c* of the flange 10*b* formed in the lens 10. Thus, the contact area between the protrusion 6 and the lens 10 can be made very small. The semicircular cross section herein also encompasses approximately semicircular and semi elliptical cross sections.

Figure 4:
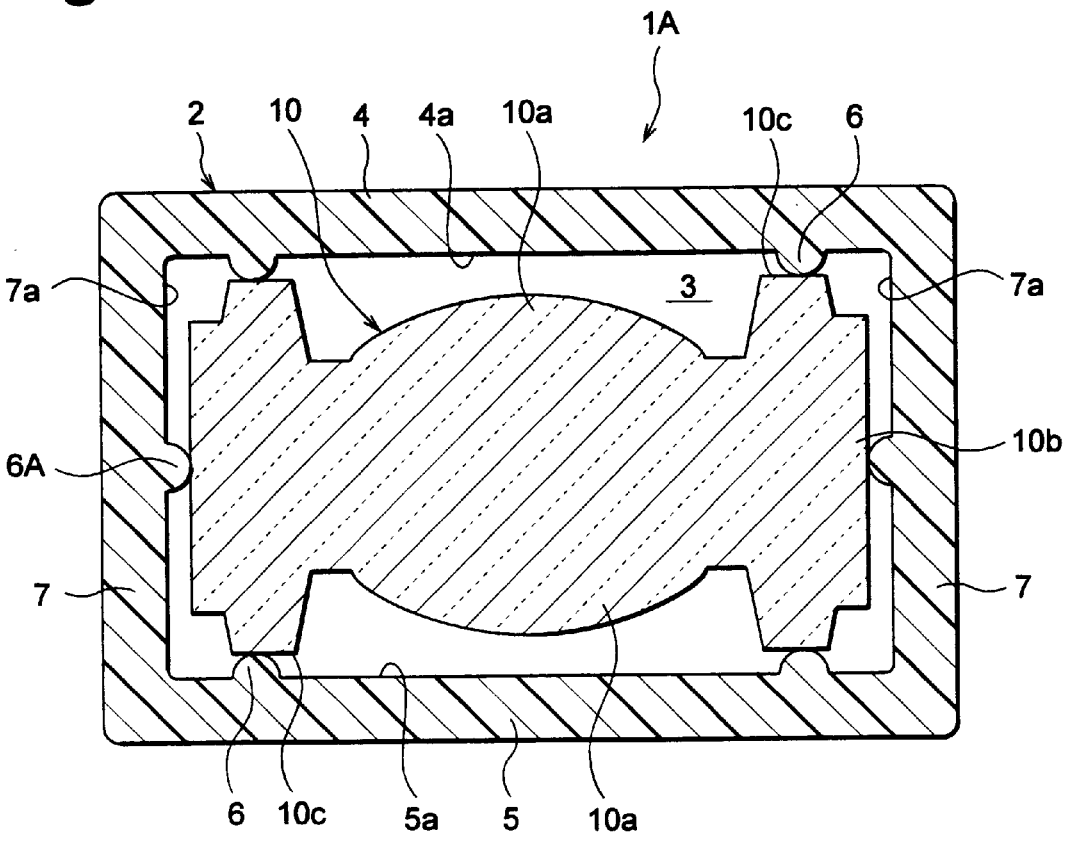
FIG. 4 is a sectional view showing a second embodiment of the lens case according to the present invention.

Since the outer periphery of the lens 10 is a cylindrical surface, the contact area between the inner face 7*a* of each side wall 7 of the case main body 2 and the lens 10 is very small. Accordingly, in the case main body 2, the protrusions 6 are formed on the upper and lower walls 4 and 5 of the walls forming the inner space 3 of the case main body 2. Alternatively, as in the lens case 1A (second embodiment) shown in FIG. 4, a protrusion 6A may be formed on the inner face 7*a* of each side wall 7. Each protrusion 6A would come into contact with the outer peripheral surface of the flange 10*b* formed in the lens 10. As a consequence, the lens 10 can be held within the inner space 3 in a very stable state. Also, the contact area between the lens 10 and the case main body 2 can be kept small.

Figure 5:
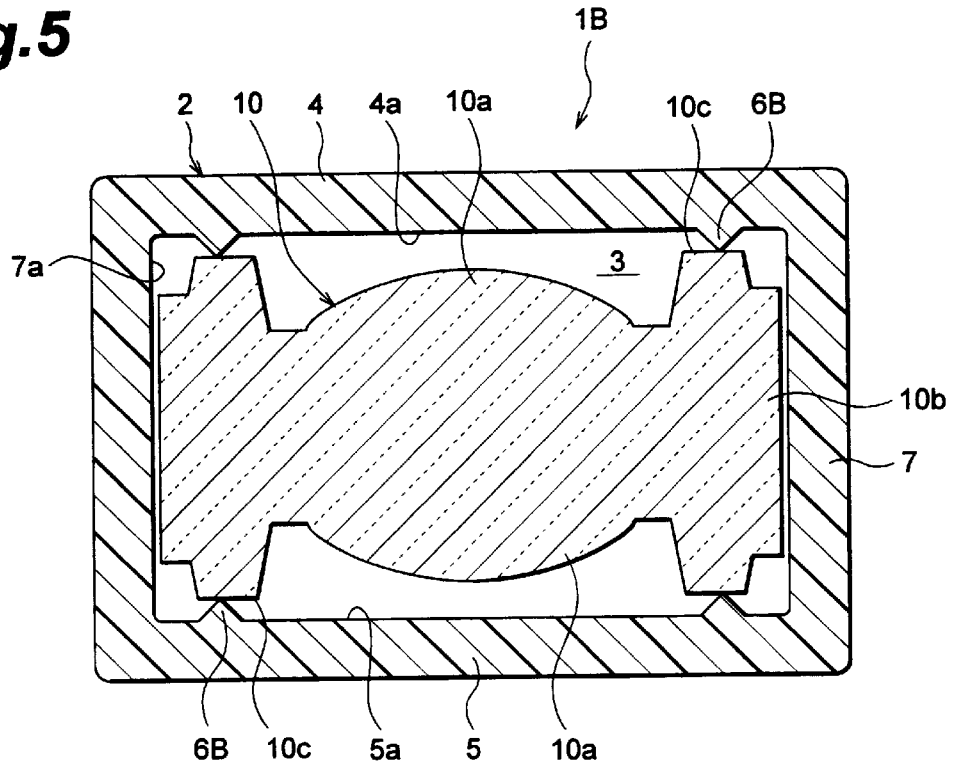
FIG. 5 is a sectional view showing a third embodiment of the lens case according to the present invention.
Figure 6:
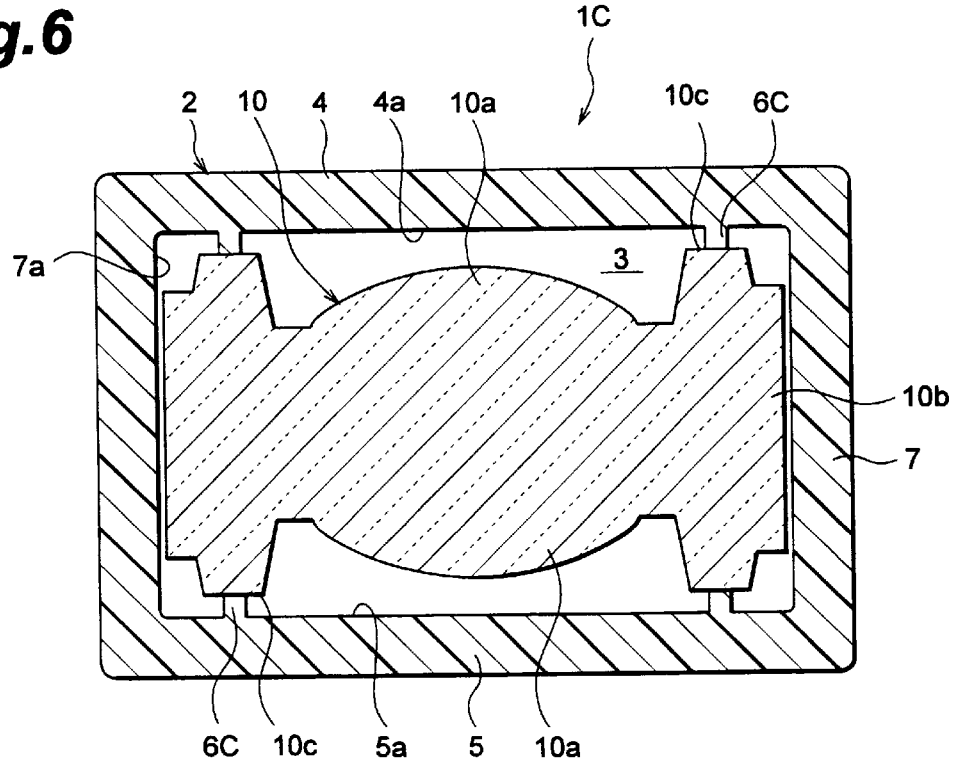
FIG. 6 is a sectional view showing a fourth embodiment of the lens case according to the present invention.

Though each protrusion 6 in the lens case 1 has substantially a semicircular cross section, it should not be restricted thereto. As with the lens 1B (third embodiment) shown in FIG. 5, the walls 4 and 5 forming the inner space 3 therebetween and opposing each other may be provided with protrusions 6B each having a triangular cross section. Further, as with the lens 1C (fourth embodiment) shown in FIG. 6, the walls 4 and 5 forming the inner space 3 therebetween and opposing each other may be provided with protrusions 6C each having a quadrangular cross section. The quadrangular cross section herein encompasses cross-sectional forms in rectangle, trapezoid, and the like. In these cases, the contact area between the lens 10 and the case main body 2 can be also reduced as compared with the case where the flat inner faces 4*a*, 5*a* of the upper and lower walls 4, 5 and the surface of the flange 10*b* come into contact with each other.

Further, though each protrusion 6 extends from one end of the case main body 2 to the other end thereof, it should not be restricted thereto. Namely, a plurality of protrusions may be interspersed along the longitudinal direction of the case main body at two walls opposing each other, so that each protrusion abuts the flange of each lens. As a consequence, the contact area between the lens and the lens case can be further reduced.

Figure 7:
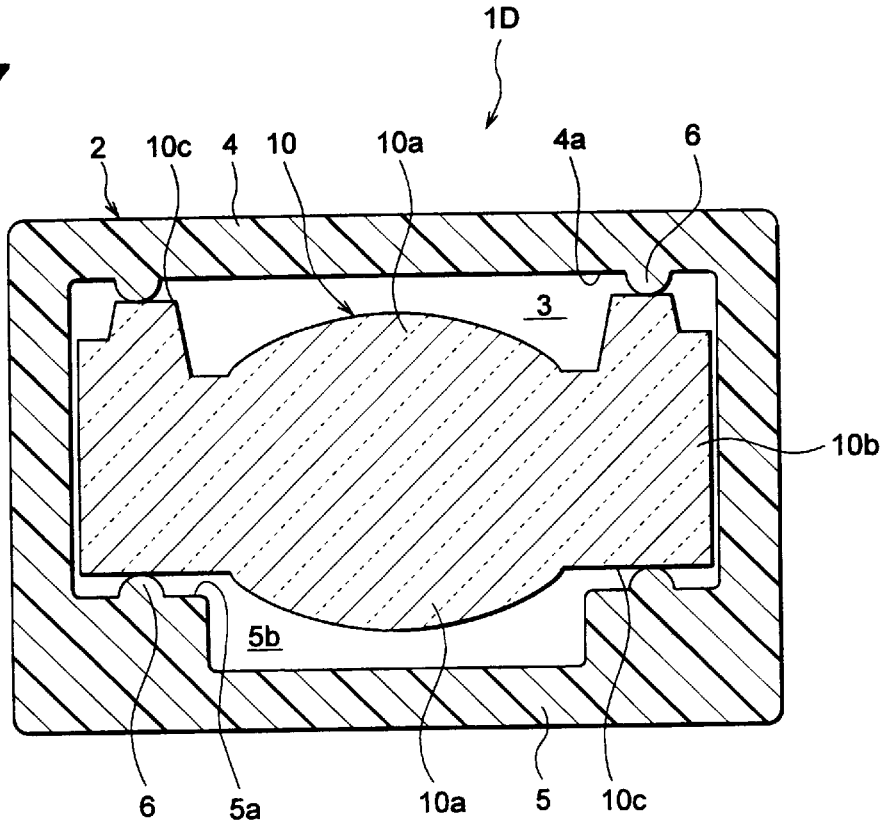
FIG. 7 is a sectional view showing a fifth embodiment of the lens case according to the present invention.

FIG. 7 is a sectional view showing a fifth embodiment of the lens case according to the present invention. The lens case 1D shown in FIG. 7 is used for accommodating therein a lens 10A which is different from the lens 10 shown in FIG. 8. On the lower side of the lens 10A, the optically functioning part 10*a* bulges from the flat part 10*c* of the flange 10*b* along the optical axis direction of the lens. Accordingly, the lower wall 5 of the case main body 2 is provided with a recess 5*b* for preventing the optically functioning part 10*a* of the lens 10A from interfering with the lower wall 5. As a consequence, when the lens 10A is accommodated in the lens case 1D, the lens 10*a* is prevented from being damaged.

Also in the lens case 1D, the friction generated between the lens 10A and the case main body 2A decreases, thereby reducing the charges of the lens 10A and case main body 2A. As a result, the lens 10 would not be attracted to the case main body 2A, whereby the ease in taking out the lens 10A is improved. Also, since the charge of the lens 10A taken out from the case main body 2A decreases, dust and dirt can be prevented from sticking to the lens 10A.

Since the present invention is constituted as mentioned above, the following effects can be obtained. Namely, as the inner face of the wall of the lens case is provided with protrusions abutting to the flange of the lens, the charges of the lens and lens case can be reduced. Accordingly, it becomes possible to materialize a lens case which is excellent in both the ease in taking out a lens and handling of the lens taken out therefrom.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A lens case containing a plurality of lenses comprising:

a tubular case body having first and second opposed walls with respective inner surfaces, and two protrusions projecting from each of the inner surfaces of the first and second walls, respective protrusions on the inner surface of the first wall being directly opposite corresponding protrusions on the inner surface of the second wall; and a plurality of lenses, each lens having a central optically functioning part and a circumferential peripheral flange surrounding and extending beyond the optically functioning part at opposite sides of the lens, wherein the plurality of lenses are disposed within the case and the flanges of the lenses abut the protrusions.

2. The lens case containing a plurality of lenses according to claim 1, wherein each protrusion extends along one inner face between ends of the case main body.

3. The lens case containing a plurality of lenses according to claim 2, wherein the two protrusions on each of the first and second inner surfaces are linear and parallel to each other.

4. The lens case containing a plurality of lenses according to claim 3, wherein each of the protrusions has a semicircular cross section.

5. The lens case containing a plurality of lenses according to claim 4, wherein the case body includes an inner space, each of the protrusions has a width b and a height h, the inner space has a width B and a height H, and $b \leqq B/5$ and $h \leqq H/5$.

6. The lens case containing a plurality of lenses according to claim 1, wherein the two protrusions on each of the first and second inner surfaces are linear and parallel to each other.

7. The lens case containing a plurality of lenses according to claim 1, wherein each of the protrusions has a semicircular cross section.

8. The lens case containing a plurality of lenses according to claim 1, wherein each of the protrusions has a triangular cross section.

9. The lens case containing a plurality of lenses according to claim 1, wherein each of the protrusions has a quadrangular cross section.

10. The lens case containing a plurality of lenses according to claim 1, wherein the case body is a synthetic resin and each of the protrusions is unitary with the case body.

11. The lens case containing a plurality of lenses according to claim 1, wherein the case body includes an inner space, each of the protrusions has a width b and a height h, the inner space has a width B and a height H, and $b \leqq B/5$ and $h \leqq H/5$.

12. The lens case containing a plurality of lenses according claim 1 wherein the lenses are plastic.

13. A lens case containing a plurality of lenses comprising:

a tubular case body having first and second opposed walls with respective inner surfaces, and two protrusions projecting from each of the inner surfaces of the first and second walls, respective protrusions on the inner surface of the first wall being directly opposite corresponding protrusions on the inner surface of the second wall; and a plurality of lenses, each lens having a central optically functioning part and a circumferential peripheral flange surrounding and extending beyond the optically functioning part at a first side of the lens but not extending beyond the optically functioning part at a second side of the lens, opposite the first side, wherein the plurality of lenses are disposed within the case and the flanges of the lenses abut the protrusions, the inner surface of the second wall facing the second side of the optically functioning parts and the inner surface of the second wall including a recess receiving the optically functioning part without contacting the optically functioning part.

14. The lens case containing a plurality of lenses according to claim 13, wherein each protrusion extends between ends of the case body.

15. The lens case containing a plurality of lenses according to claim 13, wherein the two protrusions on each of the first and second inner surfaces are linear and parallel to each other.

16. The lens case containing a plurality of lenses according to claim 13, wherein each of the protrusions has a semicircular cross section.

17. The lens case containing a plurality of lenses according to claim 13, wherein the case body is a synthetic resin and each of the protrusions is unitary with the case body.

18. The lens case containing a plurality of lenses according claim 13 wherein the lenses are plastic.

19. A lens case containing a plurality of lenses comprising:

a tubular case body having first and second opposed walls with respective inner surfaces, and two protrusions projecting from each of the inner surfaces of the first and second walls, respective protrusions on the inner surface of the first wall being directly opposite corresponding protrusions on the inner surface of the second wall; and a plurality of lenses, each lens having a central optically functioning part and a circumferential peripheral flange surrounding and extending beyond the optically functioning part, wherein the plurality of lenses are disposed within the case and the flanges of the lenses abut the protrusions.

20. The lens case containing a plurality of lenses according to claim 19, wherein each protrusion extends between ends of the case body.

* * * * *